US011713212B2

(12) United States Patent
Mollet

(10) Patent No.: US 11,713,212 B2
(45) Date of Patent: Aug. 1, 2023

(54) VEHICLE WITH SHOCK ABSORPTION FOR TRANSPORTING PASSENGERS ON A VARIABLE SLOPE TRACK AND INSTALLATION COMPRISING SAID VEHICLE

(71) Applicant: POMA, Voreppe (FR)

(72) Inventor: Alain Mollet, Voreppe (FR)

(73) Assignee: POMA, Voreppe (FR)

( * ) Notice: Subject to any disclaimer, the term of this patent is extended or adjusted under 35 U.S.C. 154(b) by 202 days.

(21) Appl. No.: 17/144,745

(22) Filed: Jan. 8, 2021

(65) Prior Publication Data

US 2021/0253398 A1 Aug. 19, 2021

(30) Foreign Application Priority Data

Jan. 8, 2020 (FR) ..... 2000137

(51) Int. Cl.
*B66B 9/06* (2006.01)
*B66B 5/16* (2006.01)
(Continued)

(52) U.S. Cl.
CPC ..... *B66B 9/06* (2013.01); *B61B 5/00* (2013.01); *B61B 9/00* (2013.01); *B61B 12/028* (2013.01);
(Continued)

(58) Field of Classification Search
CPC .... B66B 5/16; B66B 5/18; B66B 5/28; B66B 7/022; B66B 9/00; B66B 9/04;
(Continued)

(56) References Cited

U.S. PATENT DOCUMENTS 4,026,388 A * 5/1977 Creissels ..... B66B 9/06 187/245
6,216,826 B1 * 4/2001 Botzet ..... B60T 17/18 187/375
9,038,780 B2 * 5/2015 Drew ..... B66B 5/20 187/245

FOREIGN PATENT DOCUMENTS

FR 3012121 4/2015
FR 3012121 A1 * 4/2015 ..... B66B 5/06
(Continued)

OTHER PUBLICATIONS

Search Report for French Publication No. FR2000137, dated Sep. 11, 2020, 2 pages.

*Primary Examiner* — S. Joseph Morano
*Assistant Examiner* — Cheng Lin
(74) *Attorney, Agent, or Firm* — Ray Quinney & Nebeker P.C.; Paul N. Taylor

(57) ABSTRACT

The invention relates to a vehicle (1) for transporting people on a sloping track (V) of a cable transport installation, said vehicle comprising a carriage (10) suitable for running on the track (V) while being drawn by at least one traction cable (C1) of the transport installation, a cabin support (120) carried by the carriage (10), an onboard braking device (14) and a shock absorber (13) linked to the onboard braking device and to the cabin support (120), and suitable for transforming the kinetic energy of the cabin support (120) into heat when the cabin support (120) moves relative to the onboard braking device (14) along a shock absorption trajectory in the shock absorption direction, characterized in that the onboard braking device (14) is rigidly connected to the carriage (10) and the vehicle also comprises a slide link (12) between the cabin support (120) and the carriage (10) to guide a movement of the cabin support (120) relative to the carriage (10) along the shock absorption trajectory.

20 Claims, 7 Drawing Sheets

(51) Int. Cl.

| | |
|---|---|
| ***B66B 5/28*** | (2006.01) |
| ***B61B 9/00*** | (2006.01) |
| ***B61B 12/02*** | (2006.01) |
| ***B61D 1/00*** | (2006.01) |
| ***B66B 5/18*** | (2006.01) |
| ***B61B 5/00*** | (2006.01) |

(52) U.S. Cl.
CPC ..... *B61D 1/00* (2013.01); *B66B 5/16* (2013.01); *B66B 5/18* (2013.01); *B66B 5/28* (2013.01)

(58) Field of Classification Search
CPC .... B66B 9/06; B61B 5/00; B61B 9/00; B61B 12/028; B61B 12/04; B61D 1/00
See application file for complete search history.

(56) References Cited

FOREIGN PATENT DOCUMENTS

| | | | | |
|---|---|---|---|---|
| FR | 3079223 | | 9/2019 | |
| JP | H10167626 | | 6/1998 | |
| JP | 2002087263 | | 3/2002 | |
| KR | 101400806 | B1 * | 5/2014 | ..... B66B 11/0206 |
| WO | WO2010086591 | | 8/2010 | |
| WO | WO-2010086591 | A2 * | 8/2010 | ..... B66B 11/0206 |

* cited by examiner

VEHICLE WITH SHOCK ABSORPTION FOR TRANSPORTING PASSENGERS ON A VARIABLE SLOPE TRACK AND INSTALLATION COMPRISING SAID VEHICLE

TECHNICAL FIELD OF THE INVENTION

The present invention relates to the field of passenger transport and, more particularly, to a vehicle supplied for a transport installation, the movement of which is guided, sliding or running, on a track with a uniform or variable slope, being set in motion by one or more cables.

This type of transport installation may be a funicular installation running on a railroad track, an equivalent installation running on a track other than a railroad track using vehicles with tires, or alternatively a vertical or sloping lift installation.

PRIOR ART

The invention relates more precisely to damping the kinetic forces of the vehicle during deceleration arising in particular during sudden braking in exceptional circumstances or in an emergency, such as in the event of a major malfunction of the drive mechanism of the vehicle, or a case of excess speed or if the vehicle falls following the breakage of one or more of the traction cables.

Thus, document FR3012121 describes an emergency braking system for a transport installation comprising at least one cable drawn vehicle traveling on a sloping track and provided with two retractable clamps, each cooperating with a rack positioned parallel to the track to form a safety brake. Said vehicle is equipped with an onboard assembly comprising two identical shock absorber units dedicated respectively to each of the two racks. These units are formed by a shock absorber body for connection to the vehicle and a movable component guided relative to the shock absorber body in a linear trajectory between at least a waiting position and a shock-absorbing end of travel position. The two units are controlled by a common safety controller which actuates said units on detecting that the reference speed of the vehicle has been exceeded. The shock absorber units are active if the safety brake is actuated, but cannot be used in the case of emergency braking without actuating the safety brake, for example if the vehicle comes to a halt against a buffer positioned at the lower end of the track, or if the traction cable of the vehicle suddenly decelerates.

Document JPH10167626 describes a variant of the preceding sloping lift in which the shock absorption means are positioned between a chassis portion linked to the cable and carrying the cabin, and a chassis portion carrying the safety brake and connected to the previous portion by a shock absorber. The chassis portion carrying the safety brake is located beneath the portion carrying the cable, which allows the cabin to be damped, if necessary, when the vehicle comes in contact with an end of travel stop buffer at the lower end of the track. However, the shock absorber has no effect on a sudden deceleration due to the traction cable halting.

Moreover, the shock absorption means described in this document are intended for transport installation where the tracks are certainly sloping but the slope is constant overall.

However, in installations where the tracks have a variable slope, but the attitude of the cabin must remain horizontal over the entire journey, it is necessary to ensure that in the event of emergency braking or a sudden stop, shock absorption should be progressive, reliable and effective, and should remain within the ranges prescribed by the references for both horizontal and vertical acceleration, whatever the position on the track.

DESCRIPTION OF THE INVENTION

In this context, the object of the invention is to propose a technical solution that allows the mechanical and kinematic stresses resulting from these requirements to be managed.

The invention therefore aims to incorporate energy absorption means in a transport installation comprising a vehicle traveling on a sloping track, drawn by one or more cables, for example a sloping lift installation or funicular, which energy absorption means allow the cabin to be slowed down gradually in various emergency braking scenarios initiated, for example, by slowing down one or more traction cables, by actuating a safety brake or by the vehicle reaching the limit stop against a buffer of the installation or meeting an obstacle on the track.

The invention also seeks to allow these energy absorption means to be incorporated in an installation with a slope that is not constant. This aim is achieved according to the invention by means of a vehicle for transporting people on a sloping track of a cable transport installation, said vehicle comprising a carriage suitable for running on the track while being drawn by a traction cable of the transport installation, a cabin support carried by the carriage, an onboard braking device and a shock absorber linked to the onboard braking device and to the cabin support, and suitable for transforming the kinetic energy of the cabin support into heat when the cabin support moves relative to the onboard braking device along a shock absorption trajectory in the shock absorption direction, characterized in that the onboard braking device is rigidly connected to the carriage and the vehicle also comprises a slide link between the cabin support and the carriage to guide a movement of the cabin support relative to the carriage along the shock absorption trajectory.

According to an advantageous characteristic, the shock absorption trajectory is rectilinear.

According to a preferred embodiment of the invention, the carriage is provided with at least one set of wheels for running on the track, the set(s) of wheels defining a running plane, the shock absorption trajectory preferably being parallel to the running plane.

According to another characteristic, the carriage is provided with a connection interface to the traction cable.

According to an optional variant, the vehicle also comprises a cabin and a pivot link between the cabin and the cabin support.

Said pivot link is preferably mounted beneath the floor of the cabin.

According to other optional characteristics, the vehicle comprises a cabin attitude maintenance device, preferably comprising at least one set of one or more rollers intended to cooperate with at least one auxiliary rail of the installation to guide and correct the attitude of the cabin.

According to a variant, the carriage is provided with a buffer intended, in an emergency, to come in ultimate contact with a stop at a lower end of the track.

The shock absorber may be of any type that allows energy to dissipate, particularly by solid friction, plastic deformation of a material, or by electromagnetic or hydraulic means. Multiple-use energy dissipation means will of course be preferred which may, following an emergency stop triggering said means, be reset by returning the cabin support to the operational position. According to a particularly advantageous embodiment, the shock absorber is a long-stroke hydraulic cylinder, having a stroke of more than 1 m, and preferably of more than 1.8 m. Of course, this stroke may vary considerably depending on the characteristics of the installation, particularly in terms of speed and slope, but also in terms of the regulatory requirements, depending for example on whether it is a sloping lift installation, a funicular or an amusement facility.

According to other particular variants, the onboard braking device on the carriage comprises a safety brake or a retarder.

According to one embodiment, the vehicle comprises a locking device to lock the shock absorber or to lock the cabin support in position relative to the carriage if a triggering condition is not fulfilled, and to release the shock absorber or the cabin support if the triggering condition is met. The shock absorber is therefore only active when needed, and does not interfere with the normal operation of the installation, for example in the boarding and disembarkation phases or in movement phases below the prescribed acceleration limits.

The triggering condition may be determined by one or more sensors, in particular speed, vertical or horizontal acceleration, or slope sensors, or simply a malfunction warning. The triggering condition may be a threshold for a sensor being exceeded, or a more complex condition, for example depending on two parameters such as speed or acceleration and slope. The triggering condition may also be determined by guard locking between the locking device and an onboard braking mechanism on the vehicle, in particular an emergency brake, safety brake, retarder or speed limiter or between the locking device and a collision detector (for example a detection cable held taut at the lower end of the carriage). The sensor may also be incorporated in the lock, providing that stress in excess of a given threshold on the lock should lead, preferably reversibly, to a change in the state of the lock.

The sensor may also be incorporated in a triggering push button or any triggering control device of the onboard braking device.

The locking device may comprise a lock arranged directly between the carriage and the cabin support. Alternatively or additionally, the locking device may comprise a lock for locking a movable component of the shock absorber in position relative to a body of the shock absorber, one of the two shock absorber elements formed by the movable component of the shock absorber and the body of the shock absorber being attached to the carriage and the other of the two shock absorber elements being attached to the cabin support.

Preferably, a device for resetting the shock absorber is provided, suitable for moving the cabin support relative to the carriage, in the direction opposite to the shock absorption direction, to the operational position. Said device preferably has motor means, which may or may not be independent of the shock absorber. It may for example be an electric motor acting by means of a kinematic mechanical transmission chain between the carriage and the cabin support. It may also be a device acting directly on the shock absorber. For example, if the shock absorber has a hydraulic cylinder, it is possible to supply the hydraulic chamber of the cylinder with a pump.

Another object of the invention is an installation for transporting people comprising a lower station, an upper station, a sloping track connecting the lower station and the upper station, at least one traction cable, at least one stationary device for driving the traction cable, and at least one vehicle suitable for running on the sloping track and being drawn by the traction cable, characterized in that the vehicle is a transport vehicle having the characteristics described above. The terms "lower station" and "upper station" refer in this case to two stations located at different altitudes, whether these are terminal stations or intermediate stations.

According to a variant of this installation, the transport vehicle is provided with a safety brake or retarder and is suitable for cooperating with a stationary braking rail of the transport installation. Said braking rail may in particular be a rail having a friction surface for a friction brake of the vehicle, or a rail with a rack in which a pin or retractable securing hook, rigidly connected to the carriage, is inserted.

According to another variant, a lower end of the track is provided with a stop suitable, in an emergency, for coming in contact with a buffer carried by the carriage of the transport vehicle.

According to yet another variant, the slope of the track is not constant. If appropriate, the vehicle may, in this hypothesis, comprise a cabin and a pivot link mounted beneath the floor of the cabin between the cabin and the cabin support and a cabin attitude maintenance device, preferably comprising at least one set of one or more rollers intended to cooperate with at least one auxiliary rail of the installation to guide and correct the attitude of the cabin.

Preferably, the installation comprises at least one attitude maintenance rail with which a cabin attitude maintenance device cooperates, comprising at least one set of one or more rollers intended to cooperate with the attitude maintenance rail of the installation.

According to another specific variant of the installation, the stationary device for driving the cable comprises a braking system for the cable.

The vehicle according to the invention provides balanced and stable support for the cabins on the track and at the same time high-performance shock absorption capacity in the event of braking or a sudden stop, which ensures gradual and optimal deceleration.

The installation according to the invention allows passenger transport to be provided on rising paths or trajectories with complex profiles and geometries and, in particular, on tracks with uniform or variable slopes such as parabolic tracks, while maintaining passenger comfort and ensuring passenger safety in all circumstances.

BRIEF DESCRIPTION OF THE FIGURES

Other characteristics and advantages of the invention will appear on reading the description that follows, with reference to the accompanying drawings detailed below.

For greater clarity, elements that are identical or similar are designated with identical reference signs in the text and in the figures.

Of course, the embodiments of the invention illustrated in the accompanying figures and described below are given as non-limiting examples only. It is explicitly provided that various embodiments may be combined with each other to propose other embodiments thereof.

Detailed Description of an Embodiment

The vehicle 1 according to the present invention is intended to provide passenger transport in a transport installation T which, in this embodiment, is a uniform or variable slope lift installation, but could also be a funicular or an amusement installation.

Figure 1:
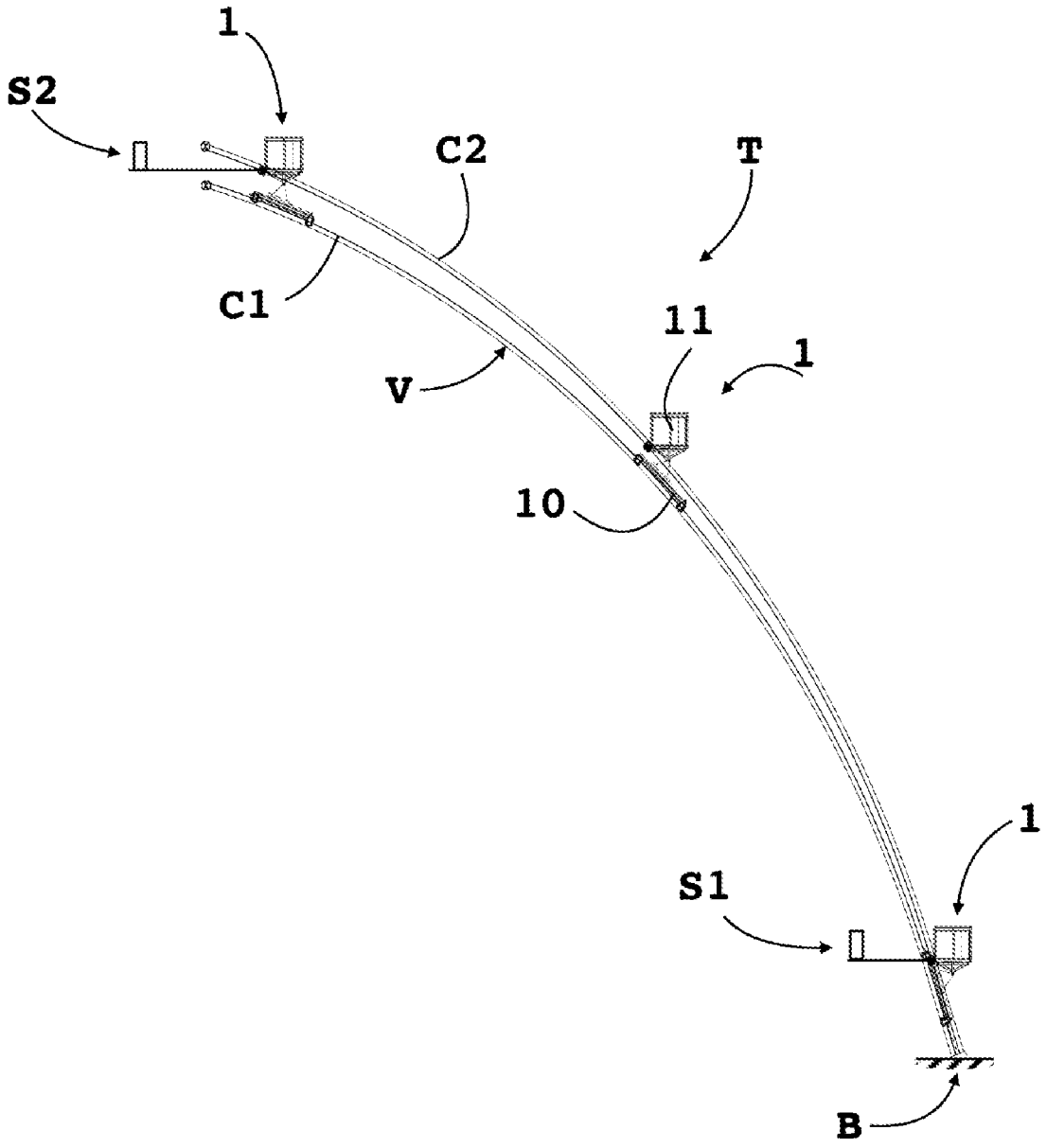
FIG. 1 is a general view of a transport installation comprising a variable slope track on which a vehicle according to the invention is moving.

In the embodiment shown in FIG. 1, this installation T comprises in this case a variable-slope curvilinear track V delimiting a parabolic path between an upper terminal station S2 and a lower terminal station S1. The lower end of the track V, below the station S1, is provided in this case with a stop B to provide a final stop for and to immobilize the vehicle 1 if the cable breaks or there is a major malfunction of the installation.

Figure 2A:
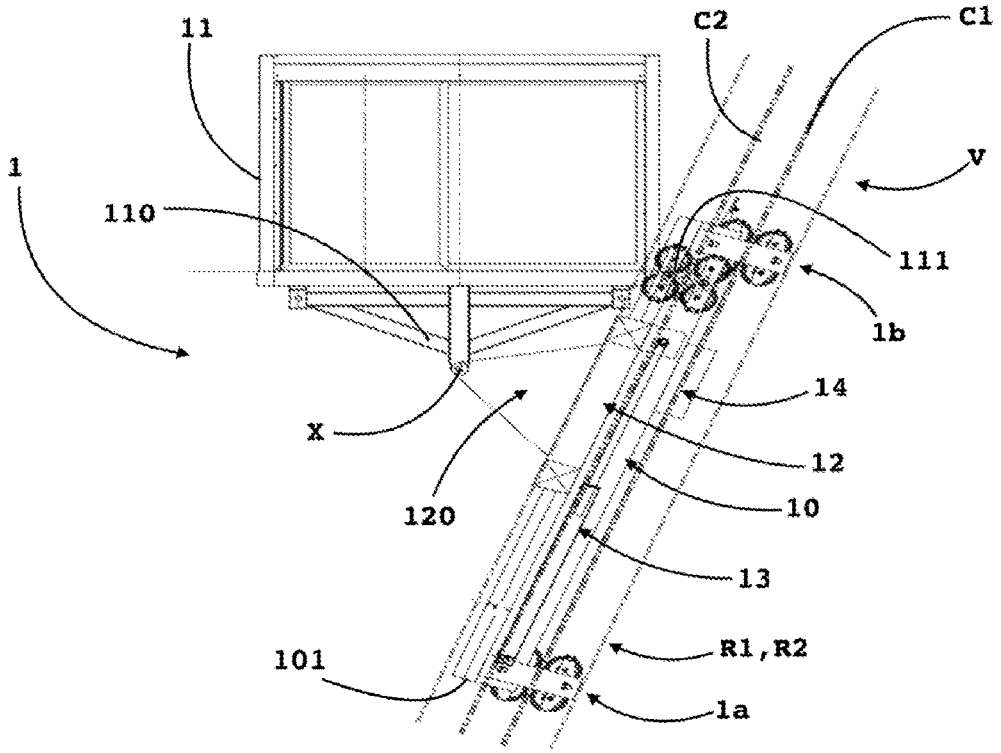
FIG. 2A is a side view of an embodiment of a vehicle according to the invention in a position corresponding to a length of the sloping track having a minimum slope, before shock absorption.
Figure 2B:
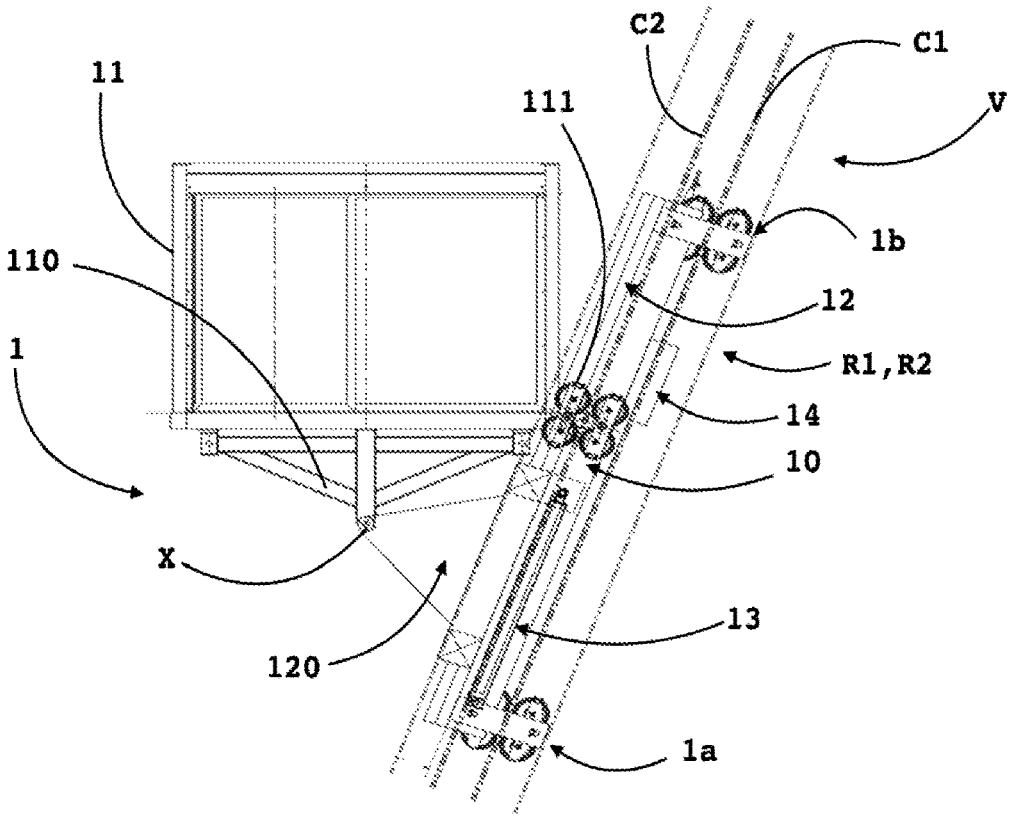
FIG. 2B is a side view of the vehicle of FIG. 2A in the same position, but after shock absorption.

In this embodiment and as shown particularly in FIG. 2A, 2B (with a steep slope) and 3A, 3B (with a gentle slope), the track V comprises, for example and in a conventional way, a railroad track with two parallel rails R1, R2, on which the vehicle 1 travels.

The vehicle 1 comprises a carriage 10 suitable for running on the track V while being drawn by at least one traction cable C1 of the transport installation T, a cabin 11 and a support 120 for the cabin 11 carried by the carriage 10. Accordingly, the carriage 10 is provided with a connection interface to the traction cable C1. The vehicle 1 also comprises a pivot link 12 between the cabin 11 and the support 120 for the cabin 11. This pivot link 12 is mounted beneath the floor of the cabin 11, as shown in particular in FIGS. 2A and 3A.

Figure 4:
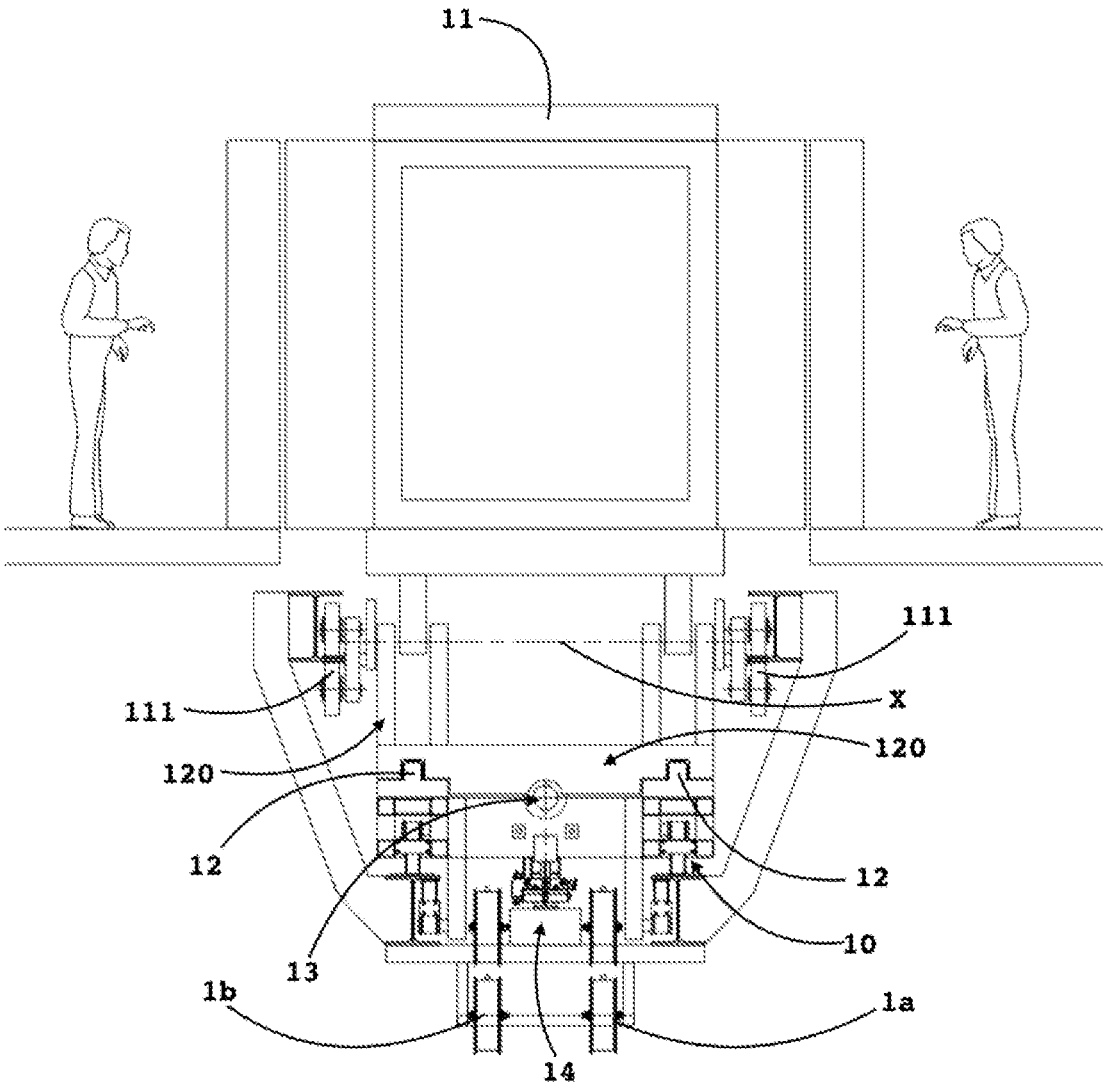
FIG. 4 is a front view of the vehicle of FIGS. 2A and 3A.

The structure of the vehicle 1 is symmetrical relative to the median vertical plane thereof such that the means described below are duplicated on either side of the vehicle and of the track, as shown in FIG. 4.

If necessary, the vehicle 1 will comprise a plurality of cabins coupled to or rigidly connected to a common support. The cable C1 is driven in a conventional way by at least one stationary driving device such as a motor (not shown).

Figure 3A:
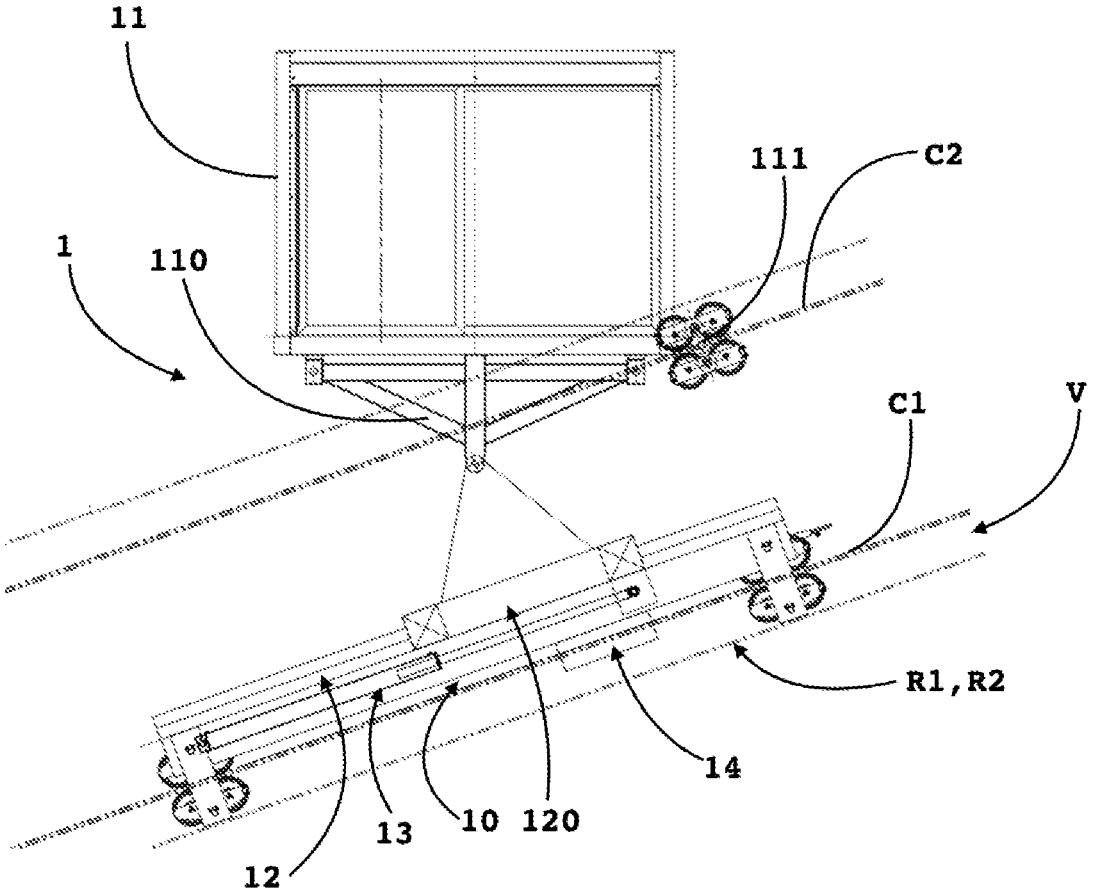
FIG. 3A is a side view of an embodiment of a vehicle according to the invention in a position corresponding to a length of the sloping track having a maximum slope, before shock absorption.

The vehicle 1 also comprises an onboard braking device 14 and a shock absorber 13 linked to the onboard braking device and to the support 120 of the cabin 11, as shown in particular in FIGS. 2A and 3A. Said shock absorber 13 is suitable for and intended to transform the kinetic energy of the cabin support 120 into heat when said support moves relative to the onboard braking device 14 along a shock absorption trajectory in a shock absorption direction in this case oriented downward.

The shock absorber 13 in this case is a long-stroke hydraulic cylinder having a stroke of more than 1 m and preferably more than 1.8 m. The other parameters of said shock absorber will be determined according to various parameters, in particular, the mass of the vehicle 1 (with its passenger load), its inertia and reference speeds.

The transport installation T is also provided with a fixed braking system (not shown) which is additional to the onboard braking device on the vehicle 1 and is rigidly connected to its infrastructure and coupled to the device driving the traction cable C1. The braking means 14, which are fixed and onboard respectively, are for example consistent with those described and illustrated in patent application FR3079223A1.

Thus, the fixed braking system incorporated in the installation T is made up, for example, of two parallel racks (not shown) extending over the entire length of the track V, each close to one of the two rails R1, R2 of the track whereas the onboard braking device 14 of the vehicle 1 is made up of a safety brake (visible in particular in FIGS. 2A and 3A).

According to a specific aspect of the invention, the onboard braking device 14 is rigidly connected to the carriage 10 and the vehicle 1 also comprises a slide link 12 between the support 120 of the cabin 11 and the carriage 10 to guide a sliding movement of the cabin support 120 relative to the carriage 10 in the shock absorption trajectory. In the embodiment of the invention shown in the figures, the shock absorption trajectory is rectilinear and the slide link 12 extends parallel to the track V.

The carriage 10 is provided with at least one set of wheels 1*a*, 1*b* for running on the track V, the set(s) of wheels defining a running plane and the shock absorption trajectory preferably being parallel to said running plane.

The vehicle according to the invention is provided with an attitude maintenance device for the cabin 11. Said device preferably comprises at least one set of one or more rollers 111 intended to cooperate with at least one auxiliary rail C2 of the installation to guide and correct the attitude of the cabin 11. Said rollers 111 are mounted in the lower portion of the structure of the cabin 11, on the side facing the track V.

As shown in FIG. 1, as the track V rises, the traction cable C1 and the auxiliary attitude cable C2 move further apart and, conversely, come closer in the lower portion of the track V. Consequently, the set of rollers 111 is preferably provided with a tilt articulation for following the cable C2 along its curve.

In its lower portion, the carriage 10 is provided with a buffer 101 intended, at the end of an emergency travel stop, to come in ultimate contact with the stop B located at the lower end of the track V. In the embodiment shown in the figures, the cabin support 120 in this case has a triangular profile, the apex of which is connected, via a spindle X, to a bracket 110 extending beneath the floor of the cabin 11. The slide 12 for its part is formed for example of a groove produced at the base of the support 120 which is engaged sliding in a rib rigidly connected to the carriage 10. The reverse configuration however is possible without departing from the scope of the invention.

In the event of emergency braking (by opening the safety brake 14 of the carriage 10 or actuation of the fixed braking system of the installation T) or a sudden stopping of the carriage 10 on the stop B, in particular, in the event of a major malfunction of the installation or a breakage of one of the cables, and owing to the kinetic energy of the vehicle 1, the support 120 of the cabin 11 slides downward in the slide 12. This sliding is slowed by the shock absorber 13 which absorbs the kinetic energy of the vehicle 1 in order to control its deceleration.

The equilibrium of the vehicle 1 and in particular the attitude of the cabin 11 is maintained even in the event of emergency braking or stoppage of the vehicle because deceleration of the support 120 is controlled by the shock absorber 13 via the slide 12, ensuring passenger comfort and safety.

In FIGS. 2A and 3A, the vehicle 1 is in the normal transit phase on two lengths of the track V having different slopes of 70° and 20° respectively to the horizontal. The support 120 is in the high position on the slide 12 and the shock absorber 13 is therefore at rest.

Figure 3B:
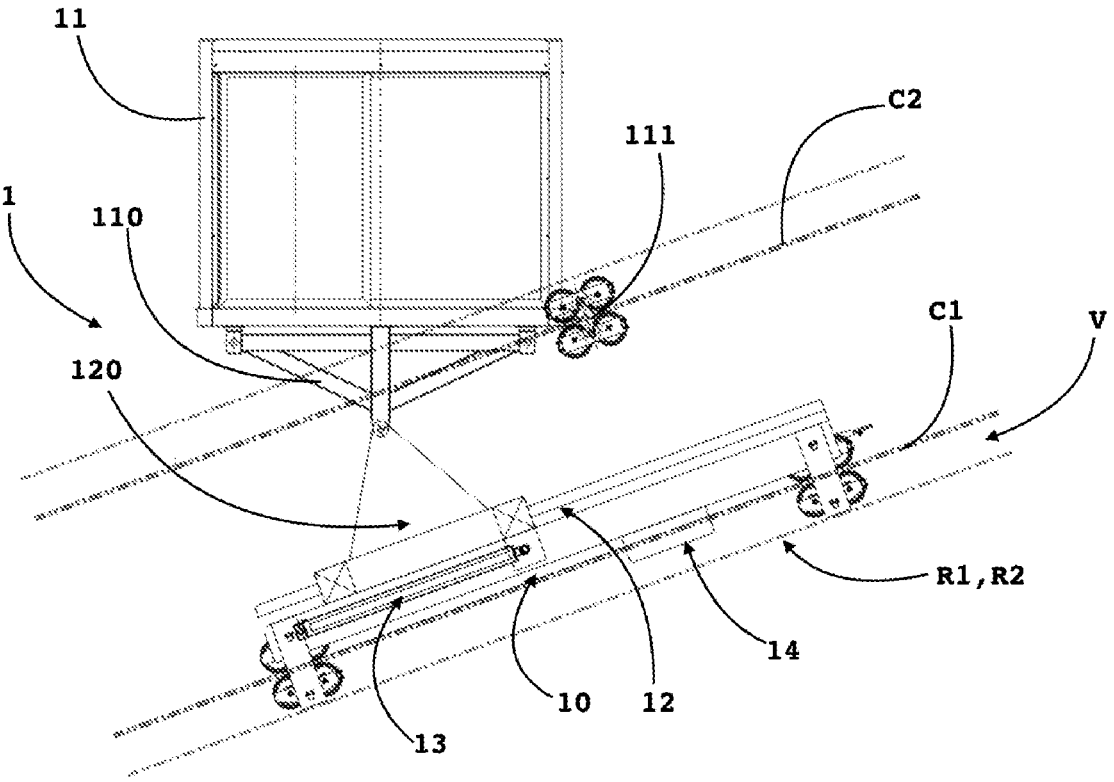
FIG. 3B is a side view of the vehicle of FIG. 3A in the same position, but after shock absorption.

FIGS. 2B and 3B correspond to the same vehicle 1 travelling on the same lengths of the track V as those in FIGS. 2A and 2B but in a situation of sudden slowdown or emergency stop. In this case, owing to the inertia of the vehicle 1, the support 120 is carried downward on the slide 12, but the shock absorber 13 absorbs its kinetic energy partly by heat dissipation and therefore slows the movement of the support 120 and thus of the cabin 11. The cabin 11 is therefore brought gradually to a halt.

Figure 5:
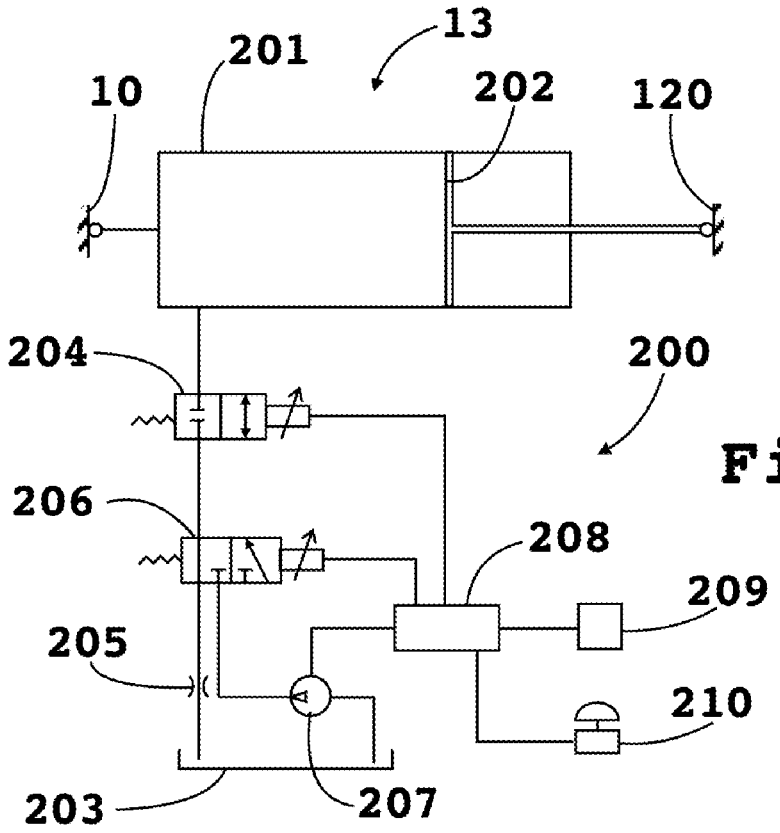
FIG. 5 is a diagrammatic view of a hydraulic shock absorption control circuit for the vehicle in the previous figures, incorporating a hydraulic locking device for the shock absorption of the vehicle.

FIG. 5 shows a hydraulic circuit 200 controlling the hydraulic shock absorber 13, which comprises a variable volume chamber 201 rigidly connected to the carriage 10 and in which a piston 202 rigidly connected to the support 120 of the cabin 11 slides. The variable-volume chamber 201 is connected to a tank 203 by means of a shock absorption control valve 204 and a restriction 205. Optionally, a fill control valve 206 allows the variable volume chamber 201 to be connected to a pump 207.

By default, the shock absorption control valve 204 isolates the variable-volume chamber 201, and the fill control valve 206, if present, connects the shock absorption control valve to the loss of pressure 205. A control circuit 208, controlled by an accelerometer 209 positioned on the carriage 10, causes the shock absorption control valve 204 to change state if a deceleration threshold for the carriage 10 is exceeded. Once stopped, a manual control 210 allows the pump 207 and the fill control valve 206 to be actuated to fill the variable volume chamber 201 and return the movable support 120 of the cabin 11 to the operational position.

This therefore allows the hydraulic shock absorber 13 to be actuated only when necessary. As the actuation time is no more than a few milliseconds, this is sufficiently brief for the admissible acceleration threshold in the cabin 11 not to be exceeded.

The device in FIG. 5 is only one of various solutions envisaged for locking the cabin support 120 in position relative to the carriage 10 in the operational position with no sudden deceleration. In a variant, provision may be made for the shock absorption control valve 204 to be directly controlled by the hydraulic pressure in the variable-volume chamber 201, or more generally by a mechanical or hydraulic signal indicating that a stress threshold between the variable-volume chamber 201 and the piston 202 has been exceeded.

Figure 6:
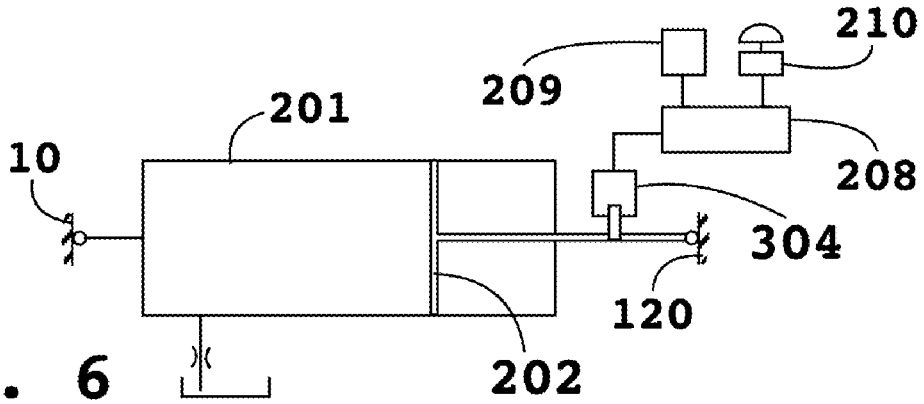
FIG. 6 is a diagrammatic view of another embodiment of a locking device for the shock absorption of the vehicle.
Figure 7:
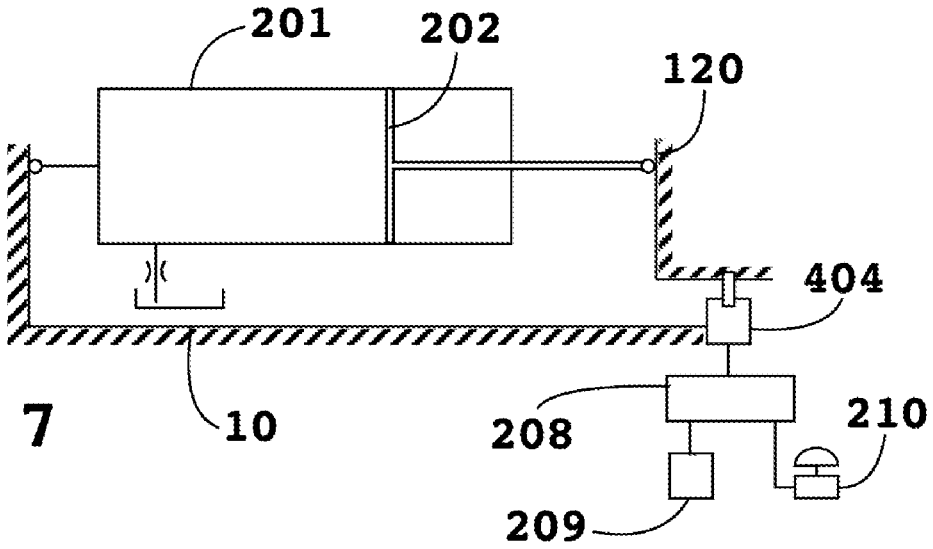
FIG. 7 is a diagrammatic view of a third embodiment of a locking device for the shock absorption of the vehicle.

Other types of locking may be provided between the chamber 201 and the piston 202 of the shock absorber 13, for example by means of a mechanical lock 304 rather than hydraulic lock, as shown in FIG. 6. A lock 404 may also be provided and placed directly between the cabin support 120 and the carriage 10, as shown in FIG. 7. In all cases, triggering of locking will be controlled by a triggering condition related to the need for shock absorption. This triggering condition may be determined by one or more sensors, in particular speed, vertical or horizontal slope sensors, or simply a malfunction warning sensor, or by more specific sensors, for example a cable breakage sensor or an obstacle sensor. Also falling within the field of the sensors envisaged are mechanisms that produce guard locking between the lock 204, 304, 404 and an emergency brake, a safety brake, a retarder or a speed limiter.

Various modifications are, of course, possible.

The attitude of the cabin 11 may be maintained by any appropriate means, in particular by passive purely mechanical means or by active motorized means controlled by a signal representing, for example, the horizontal state of the cabin. Such a variant would be particularly suitable for installing the invention in an amusement facility where the attitude of the cabin is deliberately altered during the ride.

The invention claimed is:

1. A vehicle for transporting people on a sloping track of a cable transport installation, said vehicle comprising a carriage suitable for running on the track while being drawn by at least one traction cable of the transport installation, a cabin support carried by the carriage, an onboard braking device and a shock absorber linked to the onboard braking device and to the cabin support, and suitable for transforming kinetic energy of the cabin support into heat when the cabin support moves relative to the onboard braking device from an operational position along a shock absorption trajectory in a shock absorption direction, wherein the onboard braking device is rigidly connected to the carriage and the vehicle also comprises a slide link between the cabin support and the carriage to guide a movement of the cabin support relative to the carriage along the shock absorption trajectory.

2. The vehicle of claim 1, wherein the shock absorption trajectory is rectilinear.

3. The vehicle of claim 2, wherein the carriage is provided with one or more sets of wheels for running on the track, the one or more sets of wheels defining a running plane.

4. The vehicle of claim 1, wherein the carriage is provided with a connection interface to the traction cable.

5. The vehicle of claim 1, wherein the vehicle comprises a cabin and a pivot link between the cabin and the cabin support.

6. The vehicle of claim 5, wherein the pivot link is mounted beneath the floor of the cabin.

7. The vehicle of claim 5, further comprising a cabin attitude maintenance device comprising at least one set of one or more rollers operational to cooperate with at least one auxiliary rail of the installation to guide and correct an attitude of the cabin.

8. The vehicle of claim 1, wherein the carriage is provided with a buffer operational to come in ultimate contact with a stop at a lower end of the track.

9. The vehicle of claim 1, wherein the shock absorber is a long-stroke hydraulic cylinder, having a stroke of more than 1 m.

10. The vehicle of claim 1, wherein the onboard braking device on the carriage comprises a safety brake or a retarder.

11. The vehicle of claim 1, comprising a locking device for locking the shock absorber or for locking the cabin support in an operational position relative to the carriage if a triggering condition is not fulfilled, and for releasing the shock absorber or the cabin support if the triggering condition is met.

12. The vehicle of claim 11, wherein the locking device comprises a lock arranged directly between the carriage and the cabin support.

13. The vehicle of claim 11, wherein the locking device comprises a lock for locking a movable component of the shock absorber in position relative to a body of the shock absorber, wherein the movable component of the shock absorber and the body of the shock absorber form a set of two shock absorption elements, one of the two shock absorption elements being attached to the carriage and the other of the two shock absorption elements being attached to the cabin support.

14. The vehicle of claim 1, comprising a resetting device for resetting the shock absorber, wherein the resetting device is operational to move the cabin support relative to the carriage in the direction opposite to the shock absorption direction to the operational position.

15. An installation for transporting people comprising a lower station, an upper station, a sloping track connecting the lower station and the upper station, at least one traction cable, at least one stationary device for driving the traction cable, and at least one vehicle for transporting people, the vehicle comprising a carriage operational to run on the sloping track while being drawn by the traction cable, a cabin support carried by the carriage, an onboard braking device and a shock absorber linked to the onboard braking device and to the cabin support, and suitable for transforming kinetic energy of the cabin support into heat when the cabin support moves relative to the onboard braking device from an operational position along a shock absorption trajectory in a shock absorption direction, wherein the onboard braking device is rigidly connected to the carriage and the vehicle also comprises a slide link between the cabin support and the carriage to guide a movement of the cabin support relative to the carriage along the shock absorption trajectory.

16. The installation of claim 15, the onboard braking device on the carriage comprises a safety brake or a retarder operational to cooperate with a stationary braking rail of the transport installation.

17. The installation of claim 15, wherein the carriage is provided with a buffer operational to come in ultimate contact with a stop at a lower end of the track to ultimately halt the vehicle.

18. The installation of claim 15, wherein the vehicle comprises a cabin and a pivot link between the cabin and the cabin support and the track has a slope that is not constant.

19. The installation of claim 18, wherein the vehicle comprises a cabin attitude maintenance device comprising at least one set of one or more rollers, operational to cooperate with at least one attitude maintenance rail of the installation to guide and correct an attitude of the cabin.

20. The installation of claim 15, wherein the stationary drive device comprises a braking system for the traction cable.

* * * * *